US006155143A

United States Patent [19]

Wu

[11] Patent Number: 6,155,143

[45] Date of Patent: Dec. 5, 2000

[54] SCREWDRIVER HAVING EXPANDING AND FOLDING ACTIONS

[76] Inventor: Shu-Te Wu, No. 6, Lane 176, Wu Fu Road No. 6, Wu Feng Hsian, Taichung Hsien, Taiwan

[21] Appl. No.: 09/127,900

[22] Filed: Aug. 3, 1998

[51] Int. Cl.[7] ..... B25B 23/00

[52] U.S. Cl. ..... 81/436; 81/437; 81/490; 81/177.4

[58] Field of Search ..... 81/436, 490, 177.4; 30/162, 335

[56] References Cited

U.S. PATENT DOCUMENTS

| | | | |
|---|---|---|---|
| 1,623,906 | 4/1927 | Brooks | 30/335 |
| 3,601,170 | 8/1971 | Sciascia | 81/436 |
| 4,002,366 | 1/1977 | Hammes | 30/162 |
| 4,480,668 | 11/1984 | Lin . | |
| 5,224,402 | 7/1993 | Pettersson | 81/436 |
| 5,251,520 | 10/1993 | Lanham | 81/436 |

FOREIGN PATENT DOCUMENTS

| | | |
|---|---|---|
| 1861500 | 7/1962 | Germany . |
| 3006651 | 8/1981 | Germany . |
| 9002085 | 6/1990 | Germany . |
| 19700927 | 9/1997 | Germany . |

*Primary Examiner*—David A. Scherbel
*Assistant Examiner*—Lee Wilson
*Attorney, Agent, or Firm*—Browdy and Neimark

[57] ABSTRACT

The present invention relates to a screwdriver having expanding and folding action. The inside of its handle has a duct of the axial direction, a screw rod body penetrating the duct to slide back and forth, so as to jut out of the handle for a predetermined length, or to be received in the handle; a retaining device disposed in the handle and retains the rod body so as to cause the shank to be retained and located at a predetermined protruded length; the retaining device can be operated and controlled by a human hand to relieve the shank of the state of being retained.

51 Claims, 8 Drawing Sheets

SCREWDRIVER HAVING EXPANDING AND FOLDING ACTIONS

FIELD OF THE INVENTION

The present invention relates generally to a hand tool, and more particularly to a screwdriver having an expandable and foldable shank.

BACKGROUND OF THE INVENTION

The traditional screwdriver is composed of a handle and a metal shank fastened with the handle. The structure so formed by the traditional screwdriver has a considerable fixed length. According to the practical experience, such a structure as described above has the following drawbacks.

The general work site is of an open space. However, the work site, where the screwdriver is used, is of a narrow and confined space in which it is difficult to use the traditional screwdriver such that it is even impossible to put the screwdriver into the space in light of its excessive length.

The conventional screwdriver can not be stored or carried easily in light of its excessive length and its cumbersome size.

The metal shank of the traditional screwdriver has a pointed end which is readily exposed to inflict a bodily injury on a person who happens to carry the screwdriver.

SUMMARY OF THE INVENTION

It is the primary objective of the present invention to provide an expandable and foldable screwdriver which is adapted for use in a narrow small space.

It is another objective of the present invention to provide an expandable and foldable screwdriver which can be easily stored or carried.

It is still another objective of the present invention to provide an expandable and foldable screwdriver which is safe all the time.

The objectives, features and functions of the present invention will be more readily understood upon a thoughtful deliberation of the following detailed description of the embodiments of the present invention with reference to the accompanying drawings.

DETAILED DESCRIPTION OF THE INVENTION

Figure 1:
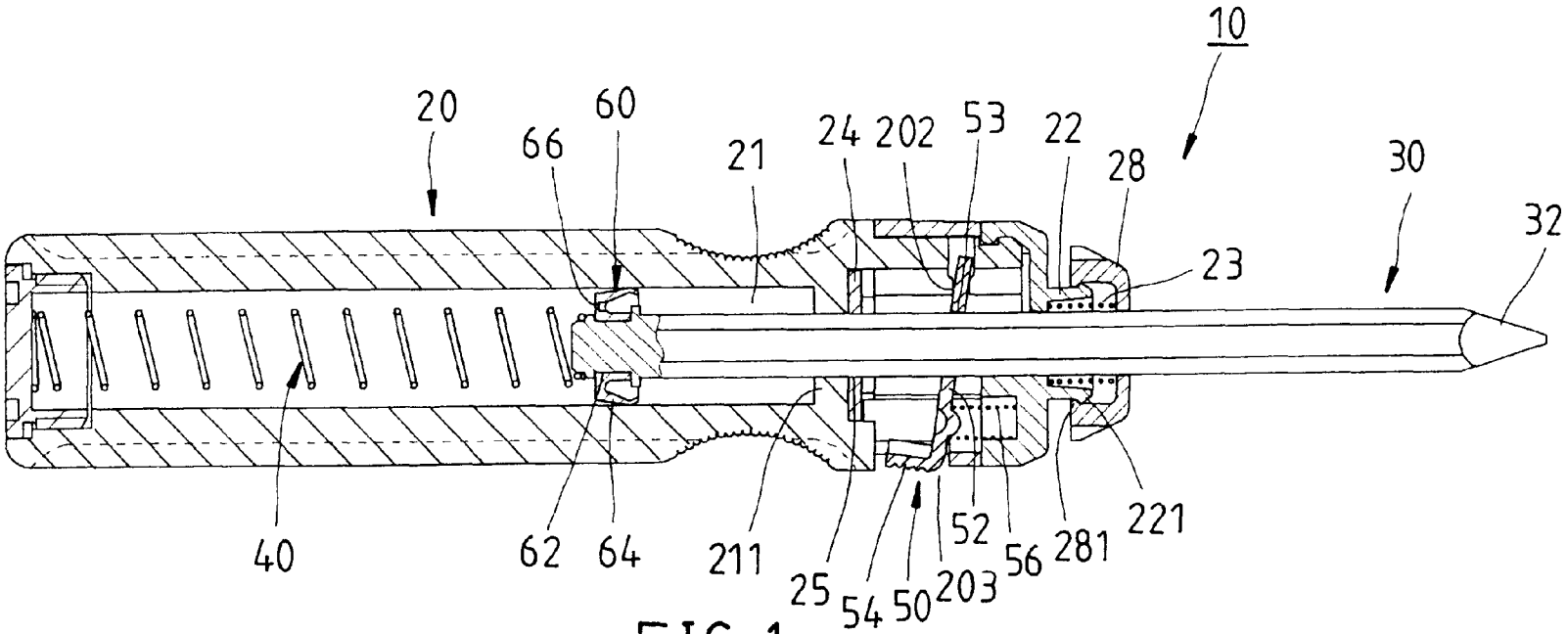
FIG. 1 shows a sectional view of an embodiment of the present invention.

As shown in FIG. 1, an expandable and foldable screwdriver 10 of the present invention comprises:

A handle 20 which is provided at the front end thereof with a duct 21 extending along the axial direction toward the inside; a ring-shaped protective cover 28 is fitted with a flat protuberance 22 of the front end of the handle 20, with a hooked portion 281 being retained by the protruded ring portion 221 so as to be secured to the handle; an elastic element 23 is disposed between the protective cover 28 and the flat protuberance 22, so as to enable the protective cover to remain a predetermined distance after sliding out of the front end of the handle at the time when the protective cover is not exerted on by an external force.

Figure 3:
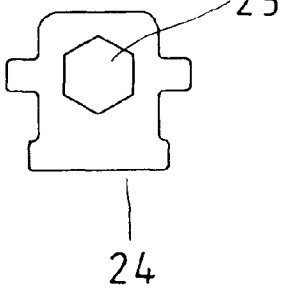
FIG. 3 shows a top view of an arresting body of an embodiment of the present invention.

A shank 30 is provided at the front end thereof with a head 32 for driving a screw, with its rod body being put in the duct 21 such that the rod body is capable of sliding back and forth. The cross section of the shank is polygonal, such as hexagonal. The periphery of the shank is engaged with a polygonal retaining hole 25 of the arresting body 24 embedded in the duct 21, so as to be driven by the handle, as shown in FIG. 3. In addition, the duct 21 is provided with a protruded retaining portion 211 identical in cross-sectional shape with the shank, within the range of a predetermined length, for driving the shank.

An elastic element 40 is disposed in the duct 21 such that the elastic element urges elastically the rear end of the shank 30 for keeping the shank 30 in the state of pushing outwardly.

Figure 2:
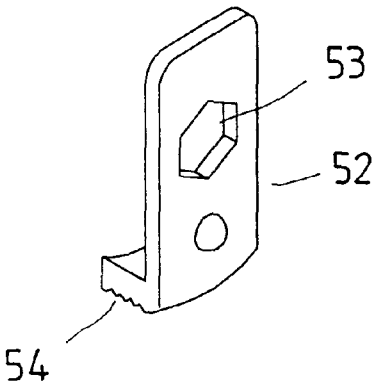
FIG. 2 shows structure of a retaining member.
Figure 4:
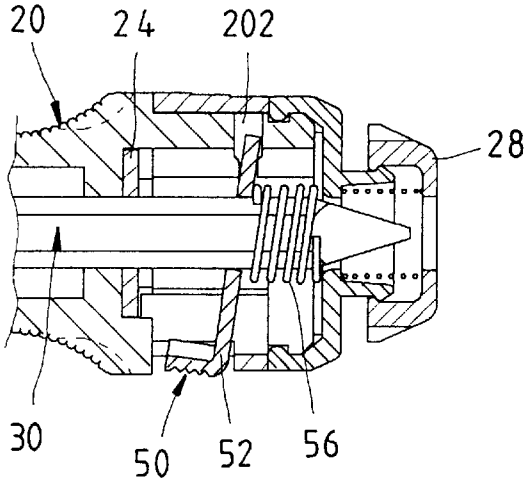
FIG. 4 shows a schematic view of another embodiment of the present invention.

A retaining device 50 of the embodiment has: a retaining member 52 of a piece body, as shown in FIG. 2, with its piece body being provided with an arresting hole 53 identical in cross-sectional shape with the shank 30 and having an inner diameter slightly greater than the diameter of the shank; an operation and control member 54 fastened with one end of the retaining member. The retaining member 52 is rotatably disposed at one end thereof in a fulcrum portion 202 located in the interior of the handle 20. The operation and control member 54 is located in an indentation 203 located in the periphery of the handle and is exposed to the outside to be dialed. The arresting hole 53 is opposite to the duct 21 for receiving the shank. An elastic element 56 is disposed between the handle and the retaining member 52 and is provided with an elasticity capable of keeping the retaining member to swing toward the rear end of the handle. The elastic element 56 may be located at one side of the shank, as shown in FIG. 1, or fitted with the shank, as shown in FIG. 4.

Figure 5:
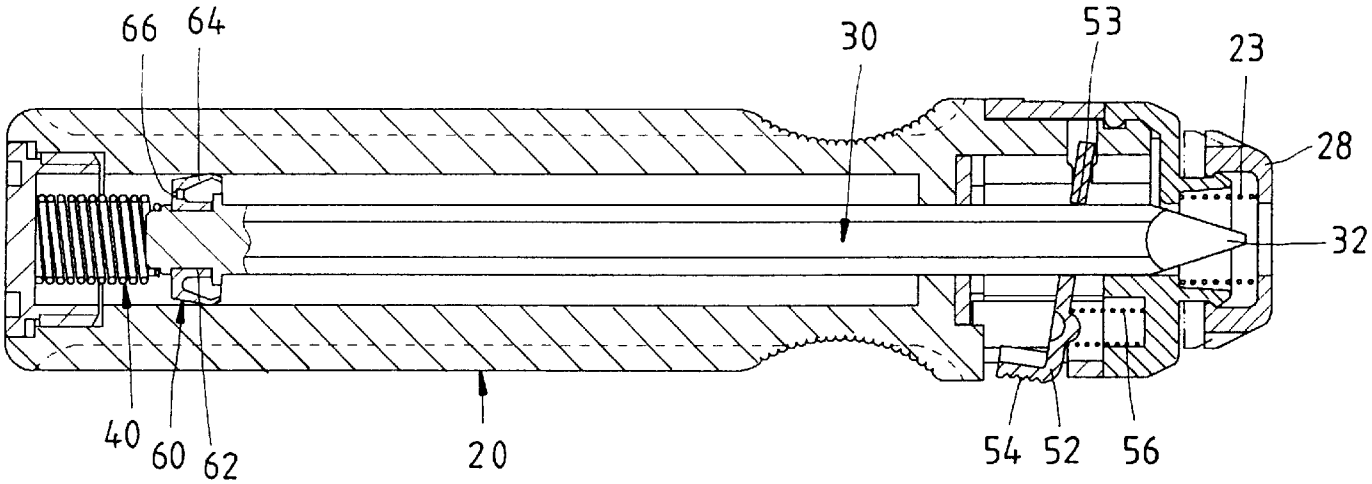
FIG. 5 shows a schematic view of the retaining member retaining the shank which is completely retracted.

As far as the use of the present invention is concerned, when the retaining member 52 is not exerted on by an external force, the retaining member 52 is urged by the elastic element 56 to swing obliquely toward the tail end of the handle. In the meantime, the arresting hole 53 is in contact with the shank, as shown in FIG. 5. The elastic force of the elastic element 56 is capable of keeping the retaining member in the state of swinging aside so as to enable the shank to be retained by the retaining member to remain in the state of being located, without jutting out.

Figure 6:
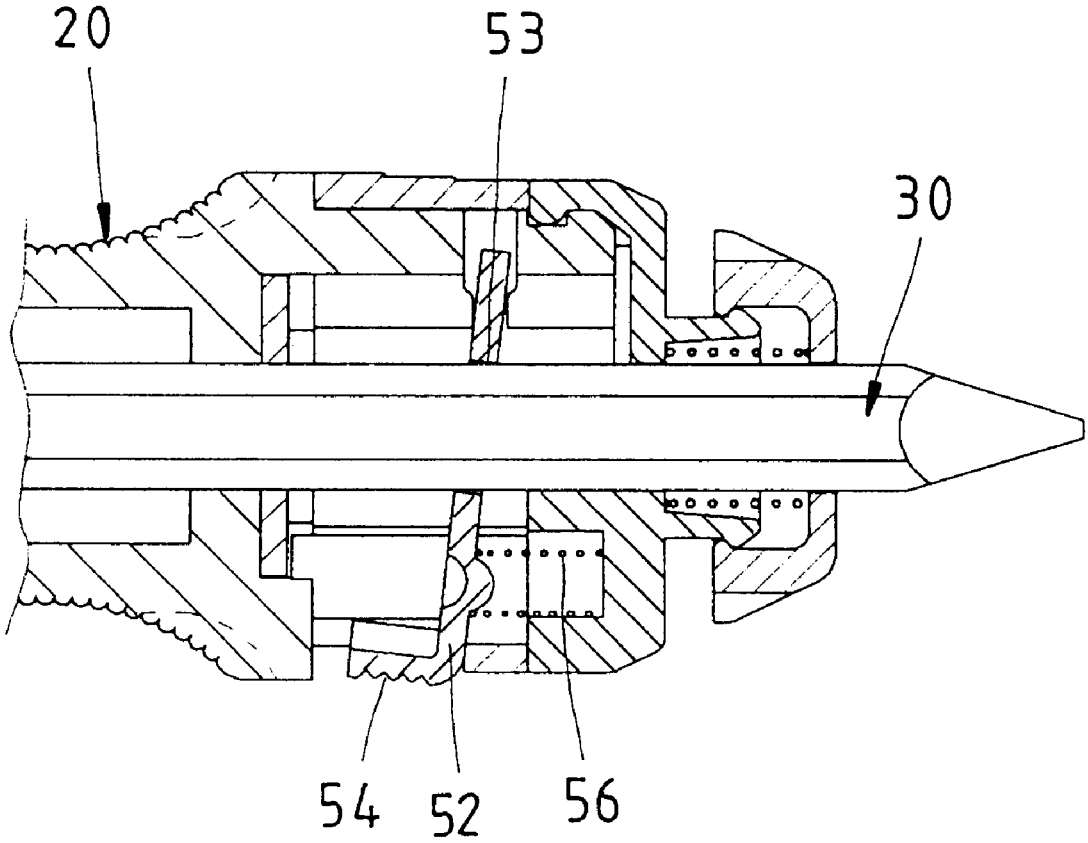
FIG. 6 shows a schematic view of the shank which is not retained by the retaining member.

When the operation and control member 54 is manually moved toward the front end of the handle, the piece body of the retaining member 52 swings toward the front end of the handle to remain in the state of being normal to the shank, as shown in FIG. 6. In the meantime, a gap is formed between the arresting hole 53 and the shank 30 in light of the difference in the angle of obliquity of the retaining member, so as to relieve the shank of being retained by the retaining member. The shank is therefore urged by the elastic element 40 to extend toward the front end of the handle. As the shank 30 has extended for a length that is called for, the force exerting on the operation and control member 54 can be relieved of, so as to cause the elastic element 56 to urge the retaining member 52 toward the rear end of the handle, as shown in the state of FIG. 5. As a result, the rod member is once again retained by the retaining member and located at the extended length.

As the screwdriver 10 is at work to turn a screw, the shank 30 is axially exerted on by a force of the user of the screwdriver 10 and is forced to move toward the interior of the handle. Under such circumstance, the arresting hole 53 of the retaining member 52 is engaged with the shank. For this reason, when the shank is moved inwardly, the retaining member 52 is actuated to swing aside toward the rear end of the handle, thereby causing the angle formed between the retaining member and the shank to become smaller. The gap between the arresting hole 53 and the rod member is thus become intense. The shank is retained more securely by the retaining member. The force exerting on the shank to cause the shank to retract along the axial direction becomes greater, the force by which the shank is retained by the retaining member becomes greater. As a result, the shank can not be retracted at the time of operation.

Upon completion of operation, the shank is retracted. In the meantime, the operation and control member 54 is pushed to move toward the front end of the handle. As a result, the shank is relieved of being retained. The shank can be exerted on by the force of an operator to move inward such that the shank is completely received in the handle. The shank is then retained and located by the retaining member. In the process of the shank being retracted completely into the handle, the protective cover 28 is touched and displaced toward the handle, as shown by the imaginary line in FIG. 5. Upon not being touched by the external force, the protective cover 28 is urged by the elastic element 23 to displace again outward, as shown by the solid line in the drawing. The protective cover can therefore jut out of the front end of the shank to provided a safety protection measure for preventing the workers from being injured by the pointed head portion 32 of the shank.

Figure 7:
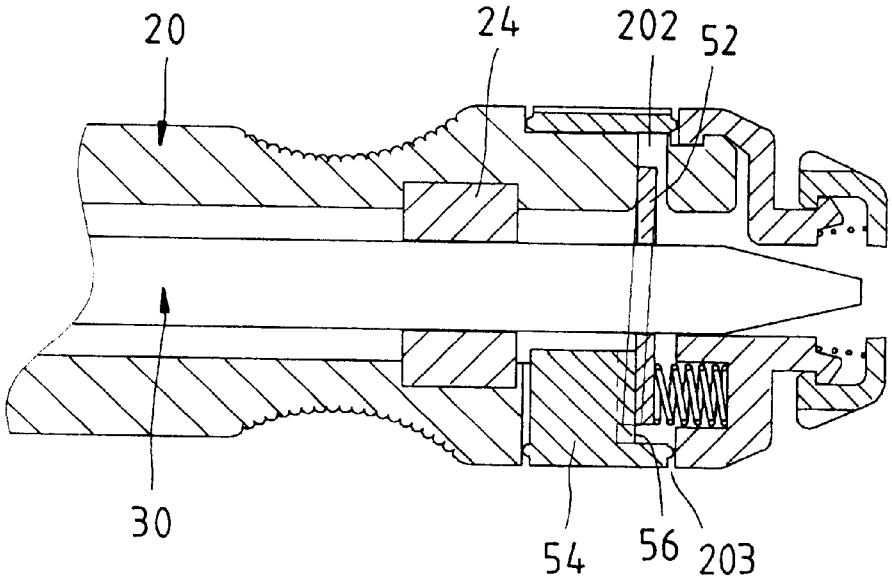
FIG. 7 shows a sectional view of still another embodiment of the present invention.
Figure 8:
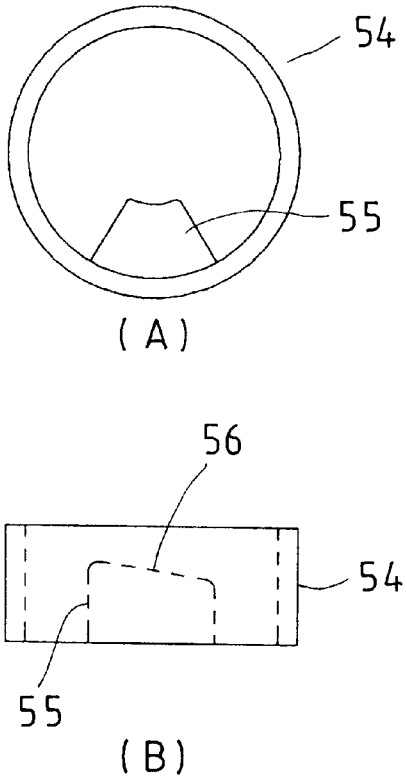
FIG. 8 shows structure of the retaining member as shown in FIG. 7.

The retaining device can be constructed as shown in FIG. 2, or FIG. 7, or FIG. 8. The operation and control member 54 of the retaining device is a ring body and is provided in the inner periphery thereof with an operation and control portion 55 which is provided in the top edge thereof with a slanted urging surface 56. The operation and control member 54 is fitted over the handle 20 such that the operation and control member 54 can rotate and displace. The operation and control member 54 is located at the indentation 203 of the handle. The urging surface 56 urges the free end of the retaining member 52. When the operation and control member 54 is rotated at various angular positions, the urging surface 56 can change the retaining member 52 at various inclinations, so as to bring about the actions of retaining or releasing the shank.

Figure 10:
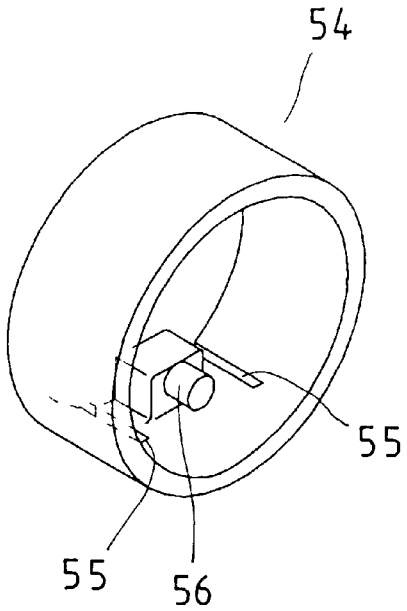
FIG. 10 shows structure of the retaining member as shown in FIG. 9.
Figure 9:
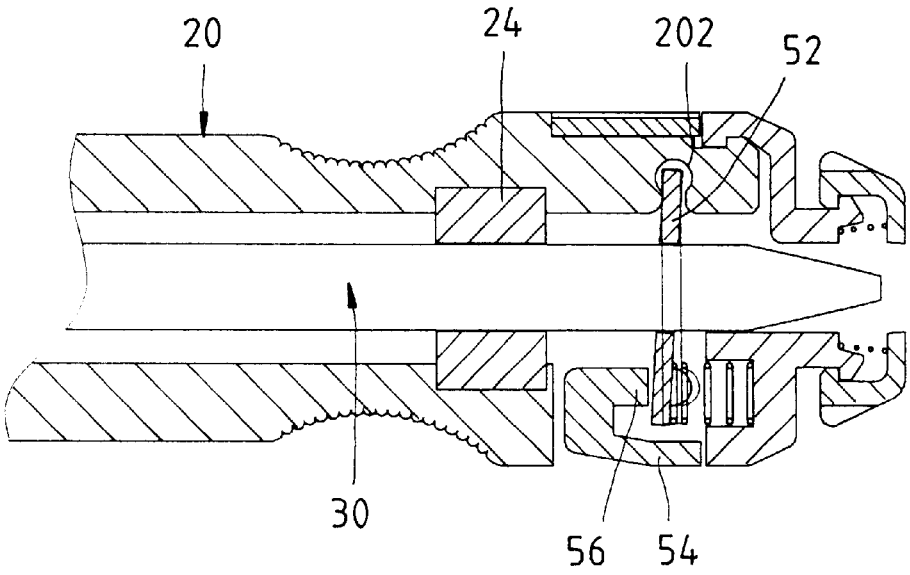
FIG. 9 shows a sectional view of still another embodiment of the present invention.

The operation and control member 54 of the retaining device can be also constructed as shown in FIGS. 9 and 10, and is fitted with the ring body of the periphery of the handle, with its peripheral wall being provided with two open slots 55. Located between the two open slots 55 is an operation and control portion 56 capable of swinging elastically. The operation and control portion 56 urges the free end of the retaining member 52. When the operation and control portion 56 is exerted on by a force, it can urge the retaining member so as to bring about the action of retaining or releasing the shank.

Figure 11:
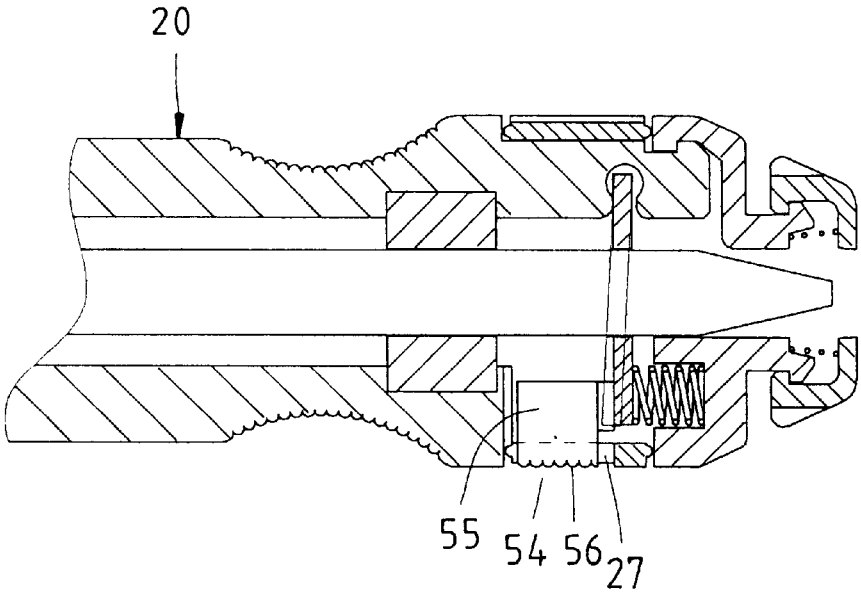
FIG. 11 shows sectional view of still another embodiment of the present invention.
Figure 12:
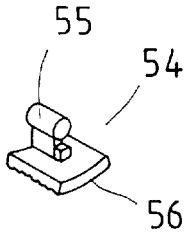
FIG. 12 shows structure of the retaining member as shown in FIG. 11.

The operation and control member 54 can be constructed as shown in FIGS. 11 and 12. The peripheral wall of the handle is provided with a slide slot 27. The operation and control member 54 is provided with a rib body 55 which is received in the slide slot 27 such that the operation and control member 54 is capable of sliding up and down. When the operator presses the press portion 56 of the operation and control member 54 to push the operation and control member to slide, the rib body 55 urges the free end of the retaining member 52 for changing the inclination of the retaining member.

Figure 13:
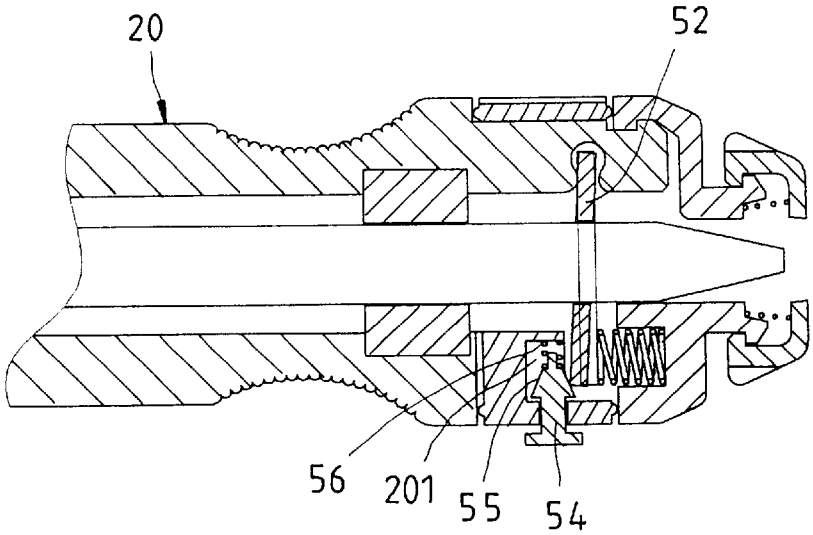
FIG. 13 shows a sectional view of still another embodiment of the present invention.

The operation and control member 54 can be constructed as shown in FIG. 13, and is fitted with the through hole of the periphery of the handle. The operation and control member 54 is provided in the inner end thereof with a tapered portion 55 which has a tapered wall urging the retaining member 52. The front end of the tapered portion 55 is urged by the elastic element 56 disposed in a recessed portion 201 of the handle. When the operation and control member 54 is pressed to slide into the handle, the tapered portion 55 can also change the inclination of the retaining member 52.

Figure 14:
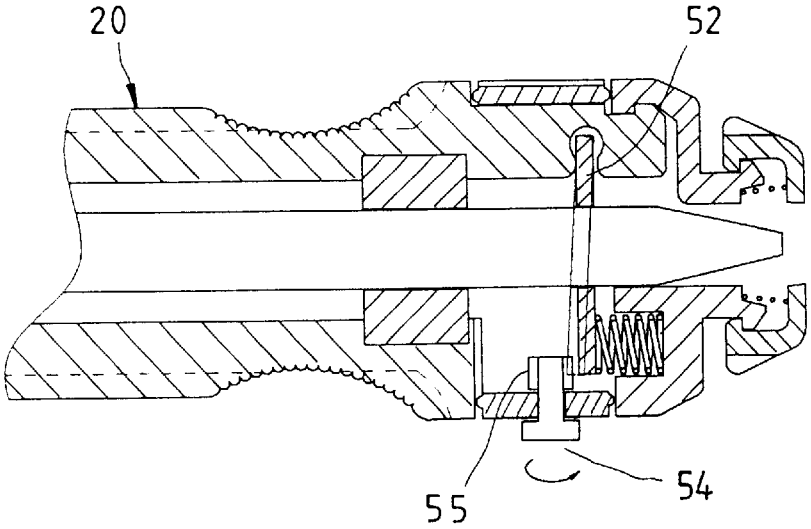
FIG. 14 shows a sectional view of still another embodiment of the present invention.

The operation and control member 54 can be constructed as shown in FIG. 14, and is fitted with the peripheral wall of the handle and provided in the inner end thereof with a cam portion 55 urging the free end of the retaining member 52. When the operation and control member 54 is turned, the cam portion 55 can change the inclination of the retaining member.

In order to prevent the elastic element 40 from urging the shank excessively, the screwdriver 10 of the present invention is provided with a damping member, which is a valve body 60, as shown in FIG. 1, and is located between the handle 20 and the shank 30. The valve body 60 is provided at the center thereof with a through hole 62 for fitting with the shank 30 such that the valve body 60 is capable of displacing along with the shank. The valve body 60 is provided in the outer periphery thereof with a lip edge 64 slanting toward the front end of the handle so as to join intimately with the wall of the duct 21. When the shank 30 is extended forward, the valve body 60 is capable of compressing the gas of the front side of the valve body. The lip edge 64 is actuated by the compressed air pressure to expand outward to remain airtight and to engage the wall of the duct, so as to bring about a damping effect which is the friction force between the valve body 60 and the wall of the duct, and the resultant of action force of the compressed air exerting on the valve body 60. The shank is therefore confined by the damping effect to jut out at a slow speed.

When the shank 30 is retracted, the valve body 60 is exerted on by the compressed air located at the rear of the valve body, so as to force the lip edge 64 to deform to move inward without making contact with the duct wall. As a result, the retraction of the shank can be carried out easily in light of the lack of friction force between the valve body and the duct.

In addition, the valve body 60 is provided with a plurality of empty air holes 66 to enable the compressed air to flow back and forth in the valve body.

Figure 15:
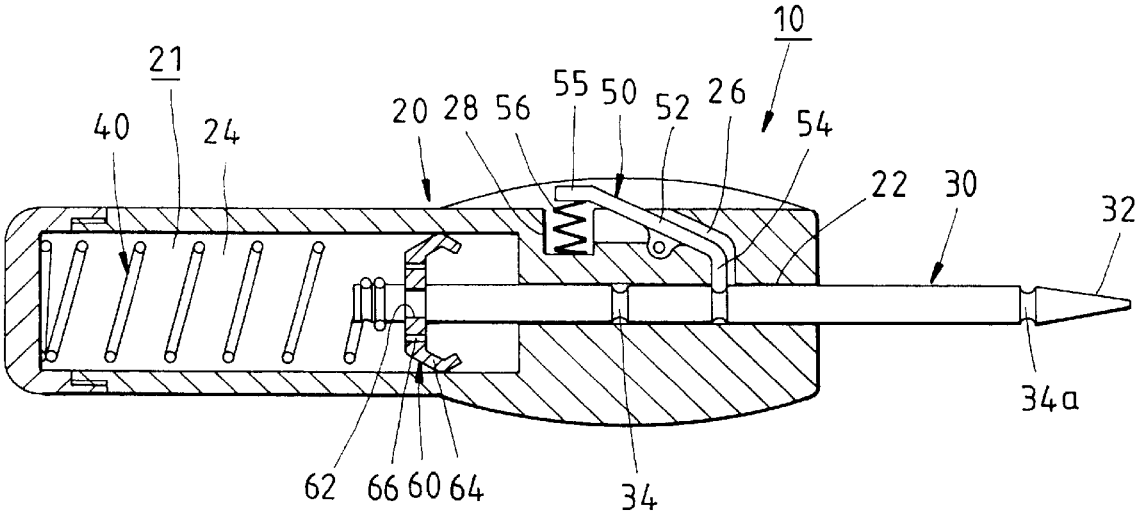
FIG. 15 shows a sectional view of still another embodiment of the present invention.

As shown in FIG. 15, another preferred embodiment of the present invention is identical with the first preferred embodiment, whereby:

The duct 21 of the handle 20 comprises: an axial hole 22 and a receiving cell 24. The shank 30 is put into the duct 21. The cross-sectional shape of the shank is the same as the cross-sectional shape of the axial hole 22 for enabling the handle to drive the shank to rotate. In addition, the rod body of the shank is provided with a predetermined number of retaining portions 34.

The retaining member 52 of the retaining device 50 is a rod member having one end being a retaining portion 54 and other end forming an operation and control portion 55. The retaining member 52 has a body portion which is fastened pivotally with a space 26 of the handle 20 and is capable of displacement. The retaining portion 54 is located in the handle and is capable of extending into the axial hole 22 to retain the rod body of the shank. The operation and control portion 55 is jutted out of the handle to facilitate the manual operation. An elastic element 56 is disposed in the receiving portion 28 of the handle such that the elastic force of the elastic element 56 urges the retaining member to remain in the state of retaining the shank.

In use, the shank 30 is relieved of the retaining by the retaining member 52 so as to enable the shank 30 to be pushed outward by the elastic element 40. As the shank 30 is jutted out of the handle 20 for a predetermined length, the retaining portion 54 of the retaining member 52 is engaged with a retaining portion 34 of the shank 30 so as to locate the shank 30 at the predetermined length. The screwdriver is ready to turn a screw.

Figure 16:
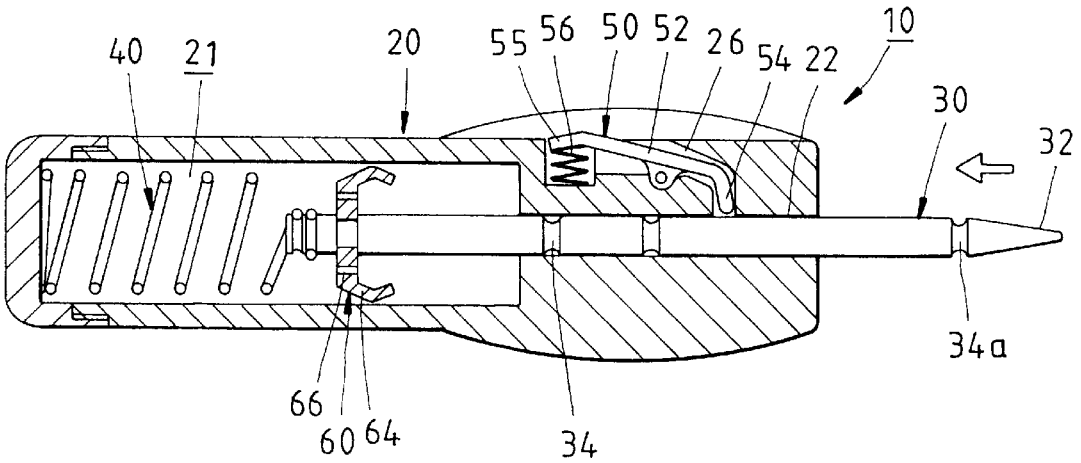
FIG. 16 shows an action view of the folding process of FIG. 15.
Figure 17:
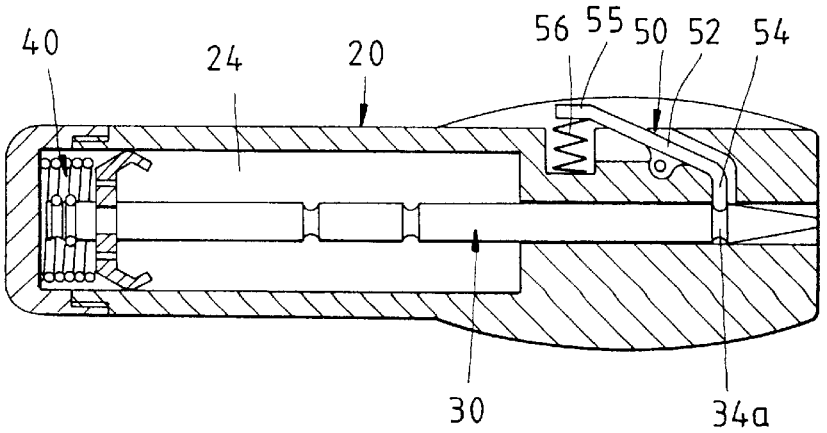
FIG. 17 shows a folding state of FIG. 15.

Upon completion of the use of the screwdriver, the operation and control portion 55 of the retaining member 52 is once again pressed to prevent the shank from being retained by the retaining member. The user can now push the shank 30 into the handle 20, as shown in FIG. 16, such that the shank is slid into the axial hole 22 and the receiving cell 24, and that the shank compresses the elastic element 40. When the shank 30 is completely retracted into the handle 20, the retaining portion 54 is engaged with a retaining portion 34*a* located at the frontmost end of the shank, as shown in FIG. 17.

The screwdriver of the present invention can be reused by pressing the operation and control portion 55 to relieve the shank 30 of the retaining by the retaining member, so as to enable the shank to be pushed out by the elastic element 40. After the shank has been extracted from the handle for an appropriate length, the retaining portion is once again engaged with a retaining portion 34 which is located at an appropriate position.

This preferred embodiment may be provided with a valve body 60 serving as a damping member for reducing the speed at which the shank is extracted.

Figure 18:
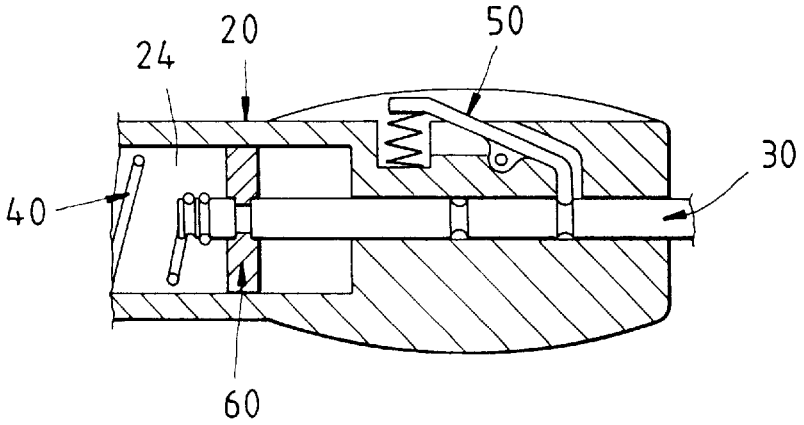
FIG. 18 shows a partial sectional view of still another embodiment of the present invention.
Figure 19:
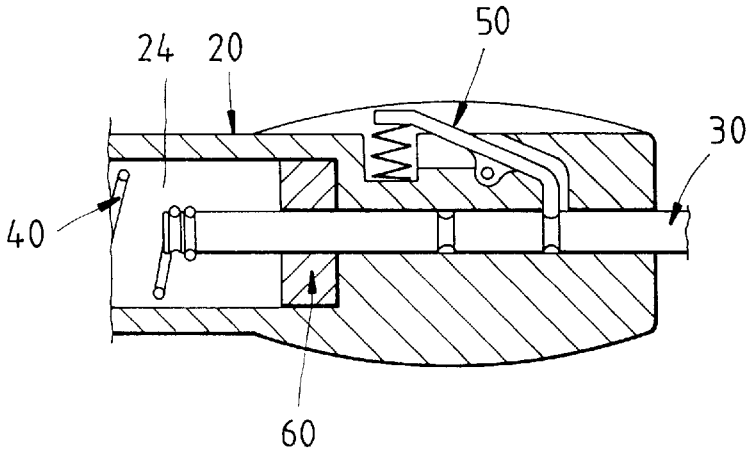
FIG. 19 shows a partial sectional view of still another embodiment of the present invention.
Figure 20:
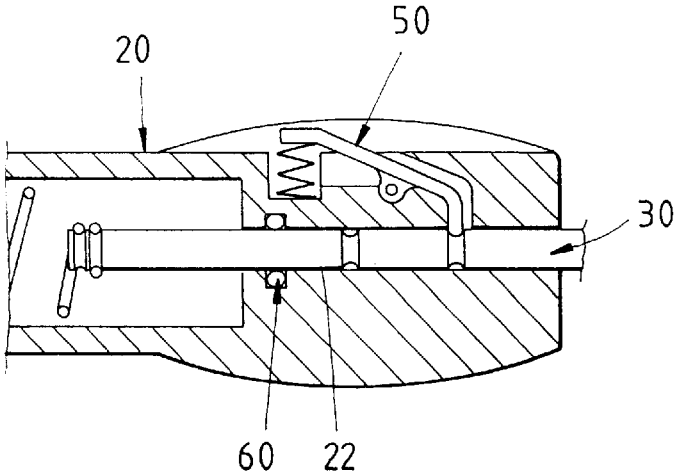
FIG. 20 shows a partial sectional view of still another embodiment of the present invention.

The damping member may be constructed as shown in FIGS. 1 and 15, or a soft ring body 60 as shown in FIG. 18. The soft ring body 60 is fitted over the shank 30 such that the soft ring body 60 is capable of moving along with the shank, and that the periphery of the ring body 60 is in contact with the wall of the receiving cell 24 to bring about a friction damping. Or, as shown in FIG. 19, the damping member may be a soft ring body 60, which is fastened in the receiving cell 24 such that the inner periphery of the ring body 60 is in contact with the rod body of the shank 30. Or, as shown in FIG. 20, the damping member is an 0 ring 60, which is disposed in the axial hole 22 to engage the rod body of the shank, so as to provide the shank with a friction damping.

The present invention has the following functions:

The screwdriver is constructed such that the shank is capable of being extracted for a plurality of lengths, for example, the full length, or the partial length. In the first preferred embodiment, the extraction length of the shank can be microadjusted in a stepless manner. As a result, the length of the screwdriver can be appropriately adjusted in accordance with the conditions of a work site. The present invention and the traditional screwdriver can be used in the open space or adjusted in length to make it shorter for use in a narrow and small space. In light of the screwdriver capable of being adjusted to have various lengths, the screwdriver can be adjusted in length to suit the user's work habit.

The shank can be completed retracted into the handle so as to bring about the reduction in length of the entire screwdriver. As compared with the traditional screwdriver, the screwdriver has a length which is about half of the length of the traditional screwdriver, so as to facilitate the storage and the carrying of the screwdriver.

When the shank is completely received in the handle, the head portion of the front end of the shank is not exposed. In the first embodiment, the present invention is provided with the protection structure of the protective cover for preventing the head of the shank from injuring a person.

It must be added here that the screwdriver provided by the present invention may be devoid of the elastic element for pushing the shank. The extraction and the retraction of the shank may be done manually.

What is claimed is:

1. A screwdriver having extending and retracting action, comprising:

a handle; a duct disposed in the handle and extending from the front end of the handle along the axial direction of the handle;

a shank having at the front a head for driving a fastening element, the shank being put in the duct to extend and retract along the duct; the shank having a rod body of a cross section of a predetermined length in the predetermined geometrical form, and capable of being driven to turn by the handle;

an elastic element disposed in the handle and located between the handle and the shank, the elasticity of the element capable of keeping the shank in the state of being pushed out of the handle;

a retaining device disposed in the handle and adjustably retaining the shank at any position along the length thereof; the retaining device capable of being operated and controlled manually, so as to relieve the shank of the retaining state.

2. The screwdriver as defined in claim 1, wherein the duct of the handle is provided in the inner wall thereof with a fulcrum portion; the retaining device having a retaining member which is a piece body having a piece body provided with an arresting hole, the arresting hole having an inner diameter slightly larger than the diameter of the shank; the retaining member provided at one end thereof with the fulcrum portion to be able to swing; the shank being put through the arresting hole; a second elastic element disposed between the handle and the retaining member, with its elasticity urging the retaining member to enable the retaining member to remain in the state of swinging toward the rear end of the handle so as to cause the arresting hole to retain the shank; an operation and control member connected with another end of the retaining member, the operation and control member capable of being operated and controlled by a human hand to change the swinging angle of the retaining member so as to cause the retaining member to swing toward the front end of the handle to relieve the shank of the stat of being retained by the arresting hole.

3. The screwdriver as defined in claim 2, wherein the operation and control member is fastened with the retaining member.

4. The screwdriver as defined in claim 2, wherein the operation and control member is a ring body provided in the inner peripheral surface with a protruded operation and control portion provided in the top edge with a slanted urging surface; the operation and control member arranged in the outer periphery of the handle to be rotated and displaced; the urging surface urging the retaining member; the operation and control member being rotated at various angular positions, the urging surface capable of changing the inclination of the retaining member.

5. The screwdriver as defined in claim 2, wherein the operation and control member is fitted with the ring body of the peripheral surface of the handle, with its peripheral wall provided with an operation and control portion capable of swinging elastically, the operation and control portion urging the free end of the retaining member; application of force and pressing the operation and control portion capable of pushing he retaining member.

6. The screwdriver as defined in claim 2, wherein the handle is provided in the peripheral wall thereof with a slide slot; the operation and control member having a rib body and a contact portion connected with the rib body; the rib body of the operation and control member disposed in the slide slot to slide up and down; the rib located in the handle to contact and urge the retaining member; contacting and pressing the contact portion to push the operation and control member to slide to enable the rib body to push and urge the retaining member.

7. The screwdriver as defined in claim 2, wherein the operation and control member is disposed in the handle peripheral surface to be normal to the duct, the operation and control member provided in the inner end with a tapered portion provided in the tapered wall urging the retaining member; a third elastic element disposed in the handle, the elasticity urging the operation and control member, with its elastic force enabling the operation and control member to remain in the state of staying far away from the retaining member; when pressing the operation and control member, the tapered portion is capable of urging the retaining member.

8. The screwdriver as defined in claim 2, wherein the operation and control member is penetrated in the handle to be normal to the duct, the operation and control member provided in the inner end with a cam portion urging the retaining member; rotating the operation and control member to enable the cam portion to change the inclination of the retaining member.

9. The screwdriver as defined in claim 2, wherein the shape of the arresting hole is the same as the shape of the cross section of the shank.

10. The screwdriver as defined in claim 2, further comprising: a damping member located between the handle and the shank for providing the shank with a damping to reduce the sliding speed of the extracting of the shank.

11. The screwdriver as defined in claim 10, wherein the handle is provided in the front end thereof with a protuberance; the protuberance provided in the periphery thereof with a protruded ring portion; the protective cover provided in the peripheral edge of the rear end thereof with a hooked portion, the hooked portion of the protective cover being stopped and retained with the protruded ring portion of the protuberance.

12. The screwdriver as defined in claim 2, further comprising: a ring-shaped protective cover disposed as the front end of the handle to be able to slide back and forth in a predetermined distance of the front end of the handle; the protective cover having a center hole opposite to the duct; an elastic element located between the protective cover and the handle to enable the protective cover to remain in the state of displacing forward.

13. The screwdriver as defined in claim 2, further comprising an arresting body provided in the end face thereof with a retaining hole corresponding in shape to the cross section of the shank, the arresting body being disposed in the handle, said retaining hole corresponding to the duct; the shank being penetrated through the retaining hole for being driven by the arresting body.

14. The screwdriver as defined in claim 2, wherein the duct is at least provided with a predetermined length of cross sectional shape identical with the cross sectional shape of the shank, for use in driving and turning the shank.

15. The screwdriver as defined in claim 2, wherein the duct comprises an axial hole connected with the front end of the handle, and a receiving cell located in the handle and in communication with the axial hole; the cross sectional shape of the axial hole being identical with the cross sectional shape of the shank engaged with the peripheral surface of the shank for driving and turning the shank.

16. The screwdriver as defined in claim 1, further comprising: a damping member located between the handle and the shank for providing the shank with a damping to reduce the sliding speed of the extracting of the shank.

17. The screwdriver as defined in claim 16, wherein the damping member is a valve body provided at the center thereof with through hole engaging the shank to move along with the shank, the valve body provided in the outer periphery thereof with a lip edge slanting toward the front end of the handle to engage airtightly with the peripheral wall of the duct.

18. The screwdriver as defined in claim 17, wherein the valve body is provided in the end surface thereof with a predetermined number of empty air holes.

19. The screwdriver as defined in claim 16, wherein the damping member is a ring body disposed in the rod body of the shank to be able to move along with the shank, with the peripheral edge of the ring body engaging the peripheral wall of the duct.

20. The screwdriver as defined in claim 16, wherein the damping member is a ring body fastened with the wall surface of the duct such that the inner peripheral edge of the ring body is engaged with the peripheral surface of the shank.

21. The screwdriver as defined in claim 1, further comprising: a ring-shaped protective cover disposed at the front end of the handle to be able to slide back and forth in a predetermined distance of the front end of the handle; the protective cover having a center hole opposite to the duct; an elastic element located between the protective cover and the handle to enable the protective cover to remain in the state of displacing forward.

22. The screwdriver as defined in claim 21, wherein the handle is provided in the front end thereof with a protuberance; the protuberance provided in the periphery thereof with a protruded ring portion; the protective cover provided in the peripheral edge of the rear end thereof with a hooked portion, the hooked portion of the protective cover being stopped and retained with the protruded ring portion of the protuberance.

23. The screwdriver as defined in claim 1, further comprising an arresting body provided in the end face thereof with a retaining hole corresponding in shape to the cross section of the shank, the arresting body being disposed in the handle, said retaining hole corresponding to the duct; the shank being penetrated through the retaining hole for being driven by the arresting body.

24. The screwdriver as defined in claim 1, wherein the duct is at least provided with a predetermined length of cross sectional shape identical with the cross sectional shape of the shank, for use in driving and turning the shank.

25. The screwdriver as defined in claim 1, wherein the duct comprises an axial hole connected with the front end of the handle, and a receiving cell located in the handle and in communication with the axial hole; the cross sectional shape of the axial hole being identical with the cross sectional shape of the shank and engaged with the peripheral surface of the shank for driving and turning the shank.

26. The screwdriver as defined in claim 1, wherein the rod body of the shank is provided with a predetermined number of retaining portions in the manner of predetermined distance; a retaining device having a retaining portion located in the handle, and an operation and control portion located in the outer side of the handle, the retaining portion engaging the retaining portions of the shank; the operation and control portion for control by a human's hand to link the retaining portion to enable the retaining portion to bring about the retaining or releasing action on the shank.

27. The screwdriver as defined in claim 26, wherein the retaining device comprises a retaining member having one end being the retaining portion, and another end being the operation and control portion, the retaining member pivoted in the handle to enable to displace by the pivoting portion acting as fulcrum; a second elastic element located between the handle and the retaining member, its elasticity capable of being used to enable the retaining member, without being exerted on by an external force, to keep the retaining portion in the state of retaining the shank.

28. The screwdriver as defined in claim 26, wherein the duct comprises: an axial hole extending inward from the front end of the handle, and a receiving cell located in the handle and in communication with the receiving cell; the cross sectional shape of the axial hole being the same as the cross sectional shape of the shank and engaged with the peripheral surface of the shank, for use in driving and turning the shank.

29. The screwdriver as defined in claim 26, further comprising: a damping member located between the handle and the shank, for use in enabling the shank to slide in the handle to bring about a damping action.

30. The screwdriver as defined in claim 29, wherein the damping member is a valve body located in the receiving cell and on the shank to be capable of displacing along with the shank; the outer periphery of the valve body having a lip edge expanding outward toward the front end of the handle; so as to contact the peripheral wall of the receiving cell.

31. A screwdriver having extending and retracting action, comprising:

a handle; a duct located in the handle and extending along the axial direction of the handle from the front end of the handle;

a shank having the front end a head portion for driving a threaded connection element; the shank penetrating through the duct to extend and retract along the duct; the shank having a rod body of a predetermined length of cross section being predetermined geometrical shape, to be driven and turned by the handle;

a retaining device disposed in the handle and adjustably retaining the shank at any position along the length thereof; the retaining device capable of being operated and controlled by a human's hand to bring about the state of the shank being relieved of the retaining.

32. The screwdriver as defined in claim 31, wherein the inner wall of the duct of the handle is provided with a fulcrum portion; the retaining device having: a retaining member being a piece body, its piece body provided thereon with an arresting hole, the inner diameter of the arresting hole being slightly larger than the diameter of the shank; the retaining member provided at one end with the fulcrum portion to be rotatable; the shank being penetrating through the arresting hole; a second elastic element located between the handle and the retaining member, with its elasticity urging the retaining member to enable the retaining member to remain in the state of swinging toward the rear end of the handle, so as to cause the arresting hole to retain the shank; an operation and control member connected with another end of the retaining member, the operation and control member capable of being operated by a human hand to change the swinging angle of the retaining member to enable the retaining member to swing toward the front end of the handle to relieve the shank of being retained by the arresting hole.

33. The screwdriver as defined in claim 32, wherein the operation and control member is fastened with the retaining member.

34. The screwdriver as defined in claim 32, wherein the operation and control member is a ring body provided in the inner peripheral surface with a protruded operation and control portion provided in the top edge with a slanted urging surface; the operation and control member located in the outer periphery of the handle to be rotated to displace; the urging surface urging the retaining member; when the operation and control member is rotated at various angular positions, the urging surface is capable of changing the inclination of the retaining member.

35. The screwdriver as defined in claim 32, wherein the operation and control member is fitted with the ring body of the peripheral surface of the handle, with its peripheral wall provided with an operation and control portion capable of swinging elastically, the operation and control portion urging the free end of the retaining member; the operation and control portion capable of urging the retaining member when the operation and control portion is exerted on by a force and pressed.

36. The screwdriver as defined in claim 32, wherein the handle is provided in the peripheral wall with a slide slot; the operation and control member having a rib body and a contact portion connected with the rib body; the operation and control member engaged with the slide slot by means of the rib body so as to slide up and down; the rib body located in the handle to urge and contact the retaining member; the retaining member being urged by the rib body when the contact portion is touched and pressed to push the operation and control member to slide.

37. The screwdriver as defined in claim 32, wherein the operation and control member is fitted with the peripheral surface of the handle such that the operation and control member is crossed with the duct, the operation and control member provided in the inner end thereof with a tapered portion, the tapered wall of the tapered portion urging the retaining member; a third elastic element disposed in the handle, with its elasticity urging the operation and control member, its elastic force enabling the operation and control member to remain in the state of being far away from the retaining member; the tapered portion capable of urging the retaining member when the operation and control member is pressed.

38. The screwdriver as defined in claim 32, wherein the operation and control member is fitted with the handle in the direction in which the operation and control member is crossed with the duct, the operation and control member provided in the inner end with a cam portion urging the retaining member; the cam portion capable of changing the inclination of the retaining member when the operation and control member is rotated.

39. The screwdriver as defined in claim 32, wherein the shape of the arresting hole is the same as the cross sectional shape of the shank.

40. The screwdriver as defined in claim 26, further comprising: damping member disposed between the handle and the shank for providing the shank with a damping to reduce the sliding speed of the shank jutting out.

41. The screwdriver as defined i claim 40, wherein the damping member is a valve body engaged with the shank by means of its center through hole to displace along with the shank, the valve body having in the outer periphery a lip edge expanding outward toward the front end of the handle, to join closely with the peripheral wall of the duct.

42. The screwdriver as defined in claim 26, further comprising a ring-shaped protective cover located at the front end of the handle and capable of sliding back and forth within a predetermined distance in the front end of the handle; an elastic element disposed between the protective cover and the handle to enable the protective cover to remain in the state of displacing forward.

43. The screwdriver as defined in claim 26, further comprising: and arresting body provided in the end surface with a retaining hole corresponding to the cross sectional shape of the shank, the arresting body located in the handle, the retaining hole is corresponding to the duct; the shank penetrated through the retaining hole for being driven and turned by the arresting body.

44. The screwdriver as defined in claim 26, wherein the duct is provided at least a predetermined length of cross section corresponding to the cross sectional shape of the shank for driving and turning the shank.

45. The screwdriver as defined in claim 26, wherein the duct comprises: an axial hole connected with the front end of the handle, and a receiving cell located in the handle and in communication with the axial hole; the cross sectional shape of the axial hole corresponding to the cross sectional shape of the shank, and engaged with the peripheral surface of the shank for driving and turning the rod body.

46. The screwdriver as defined in claim 31, further comprising: damping member disposed between the handle and the shank for providing the shank with a damping to reduce the sliding speed of the shank jutting out.

47. The screwdriver as defined in claim 46, wherein the damping member is a valve body engaged with the shank by means of its center through hole to displace along with the shank, the valve body having in the outer periphery a lip edge expanding outward toward the front end of the handle, to join closely with the peripheral wall of the duct.

48. The screwdriver as defined in claim 31, further comprising a ring-shaped protective cover located at the front end of the handle and capable of sliding back and forth within a predetermined distance in the front end of the handle; an elastic element disposed between the protective cover and the handle to enable the protective cover to remain in the state of displacing forward.

49. The screwdriver as defined in claim 31, further comprising: an arresting body provided in the end surface with a retaining hole corresponding to the cross sectional shape of the shank, the arresting body located in the handle, the retaining hole is corresponding to the duct; the shank penetrated through the retaining hole for being driven and turned by the arresting body.

50. The screwdriver as defined in claim 31, wherein the duct is provided at least a predetermined length of cross section corresponding to the cross sectional shape of the shank for driving and turning the shank.

51. The screwdriver as defined in claim 31, wherein the duct comprises: an axial hole connected with the front end of the handle, and a receiving cell located in the handle and in communication with the axial hole; the cross sectional shape of the axial hole corresponding to the cross sectional shape of the shank, and engaged with the peripheral surface of the shank for driving and turning the rod body.

* * * * *